United States Patent [19]

Granzow et al.

[11] Patent Number: 4,529,118

[45] **Date of Patent: * Jul. 16, 1985**

[54] TAMPERING-PROOF CASSETTE FOR RECEIVING CURRENCY DEPOSITS AND IDENTIFICATION CARDS

[75] Inventors: Robert H. Granzow, Miamisburg; Dale L. Placke, Dayton, both of Ohio

[73] Assignee: NCR Corporation, Dayton, Ohio

[ * ] Notice: The portion of the term of this patent subsequent to Jul. 16, 2002 has been disclaimed.

[21] Appl. No.: 522,448

[22] Filed: Aug. 12, 1983

[51] Int. Cl.[3] ..... E05G 1/00

[52] U.S. Cl. ..... 232/43.3; 109/43; 109/50; 70/439

[58] Field of Search ..... 109/31, 38, 39, 43, 109/44, 50; 70/432, 433, 435, 436, 437, 439, 440; 232/43.1, 43.3, 43.5; 312/215, 216, 218, 221

[56] References Cited

U.S. PATENT DOCUMENTS

| | | | |
|---|---|---|---|
| 506,647 | 10/1893 | Littell | 70/436 |
| 3,276,835 | 10/1966 | Hall | 312/333 |
| 3,854,655 | 12/1974 | Armstrong | 232/4 R |
| 4,131,001 | 12/1978 | Gotto | 70/14 |
| 4,253,016 | 2/1981 | Hirose | 235/381 |
| 4,275,667 | 6/1981 | Hilton | 109/44 |
| 4,337,393 | 6/1982 | Hilton | 235/487 |

FOREIGN PATENT DOCUMENTS

| | | | |
|---|---|---|---|
| 6642 | 7/1979 | European Pat. Off. . | |
| 0010598 | 5/1980 | European Pat. Off. . | |
| 22694 | 1/1981 | European Pat. Off. . | |
| 549160 | 2/1923 | France . | |
| 593280 | 5/1959 | Italy | 70/436 |
| 103173 | 3/1923 | Switzerland . | |
| 998148 | 7/1965 | United Kingdom . | |
| 2039264A | 6/1980 | United Kingdom . | |
| 2079832 | 1/1982 | United Kingdom | 70/416 |

OTHER PUBLICATIONS

Examiner's Report from U.K. Appln. No. 8202932; Filed Feb. 3, 1983, by Grant G. H. Keir et al.

U.S. application Ser. No. 509,488 filed on Jun. 30, 1983, by Grant G. H. Keir et al.

*Primary Examiner*—Gene Mancene

*Assistant Examiner*—John G. Weiss

*Attorney, Agent, or Firm*—Albert L. Sessler, Jr.; Elmer Wargo

[57] ABSTRACT

A tampering-proof container or cassette for receiving and storing items like "purged" currency bills or bank cards in association with an automated teller machine (ATM). When a "double bill" is detected from a cash dispenser in an ATM, for example, the double bill is deposited in a purge bin or cassette inside the ATM instead of being delivered to a customer as part of a routine cash dispensing transaction. The cassette has an indicator wheel therein which gives an indication of the number of times an associated, bill-receiving door is opened and closed to provide a check on potential sophisticated pilfering of bills from the cassette. A seal on a second door of the cassette must be broken to gain access to resetting levers (inside the cassette) which reset and program the indicator wheel and enable the bill receiving door to be opened. Teeth adjacent to the bill-receiving door also cooperate with the door also minimize pilfering.

6 Claims, 10 Drawing Figures

TAMPERING-PROOF CASSETTE FOR RECEIVING CURRENCY DEPOSITS AND IDENTIFICATION CARDS

CROSS-REFERENCES TO RELATED APPLICATIONS

This application is related to copending application Ser. No. 522,449 which was filed on the same date as was this application and which is also assigned to the same assignee as is this application.

BACKGROUND OF THE INVENTION

This invention relates to a portable and tampering-proof container or cassette for receiving currency "purged" from a cash dispenser or captured identification cards, for example, in association with an automated teller machine (ATM).

Stated briefly, to utilize an ATM, a customer inserts an identifying card into the machine to identify his or her account number, and then he enters certain data on the keyboard of the ATM to further identify himself and to indicate the amount of cash in the form of currency, for example, that he wishes to obtain from the ATM in a typical cash dispensing function. The ATM will then process the transaction, update the user's account to reflect the current cash withdrawal, dispense the requested currency, and return the identifying card to the customer as part of a routine operation.

The currency to be dispensed from an ATM is generally stored in containers or cassettes which are inserted into the ATM and which position the currency or bills to be withdrawn from the container by "picking" mechanisms associated with the ATM as part of a routine cash dispensing transaction described previously. After the bills are "picked", they are stored temporarily inside the ATM in what may be referred to as a "presenter" which collects the bills until the number of bills to reflect the requested cash withdrawal is reached. Thereafter, in a routine transaction, the bills collected at the presenter are dispensed to the customer.

If the ATM detects that a "double bill" (two or more bills which are overlapped) has been picked, or if it detects that one of the cassettes is out of the required number of bills to make up the monetary amount of the requested cash withdrawal, the bills which are temporarily collected at the presenter will be "purged" or deposited in a purge bin or cassette located inside the ATM instead of being dispensed to the customer. In the "double bill" situation, the ATM will make another attempt to dispense the requested amount of cash. If the ATM is out of the required bills of a certain denomination, the customer will be informed of this fact via a display associated with the ATM.

Periodically, these cassettes with the "purged" currency or bills therein are removed from the ATM by bank personnel, for example, and are then transported to the host bank where the cassettes are opened and the bills are reclaimed. In some situations, third party security firms may be responsible for the transporting of the cassettes to the host bank.

From what has been described, it is apparent that the cassettes with the purged bills therein are subject to what may be referred to as "sophisticated pilfering". This pilfering includes activities designed to remove at least some of the contents of the cassettes while making it difficult to ascertain who in the processing chain was responsible for the pilfering. It is obvious that someone bent on stealing the entire contents of the cassette could steal the entire loaded cassette at various times during the processing chain.

It should be recalled that as part of the identification procedure for using an ATM, a customer inserts his identification card into the ATM and thereafter enters other identifying data on the keyboard associated with the ATM. Sometimes a customer, through inexperience, fails to complete the identification procedure. At other times, an unauthorized user of the card (which may be stolen) fails to complete the identification procedure. The ATMs are generally designed to "capture" the identification card after a predetermined number (usually three) of unsuccessful tries at completing the identification procedure. These captured identification cards are deposited in a bin or cassette located within the ATM. Some of these cassettes are lockable and others are non-lockable.

Periodically these cassettes with the identification cards therein are removed from the ATM by bank personnel and are transported to the host bank as was done with the cassettes containing purged bills. The cassettes are opened, and the stolen cards are retained by the bank, and the cards for authorized users who failed to complete the identification procedure are returned to them.

In order to minimize the theft of valuables from the cassettes which are exposed to various people in the processing chain mentioned, cassettes which are referred to as "secure" cassettes have been developed. These "secure" cassettes generally have complex mechanisms or electrical systems which prevent an unauthorized access into the cassette by the various people in the processing chain.

SUMMARY OF THE INVENTION

This invention relates to a tampering-proof container for receiving and storing items, such as "purged" currency or captured identification cards, comprising: a housing having first and second openings therein; a first closure moveable between closed and open positions with regard to said first opening; a second closure moveable between closed and open positions with regard to said second opening; a seal to secure said second closure in said closed position and to permit said second closure to be moved to said open position only upon breaking said seal to thereby give an indication that said second closure has been opened; means for moving said first closure from said closed position to said open position to enable said items to be received through said first opening and also for moving said first closure from said open position to said closed position; means for indicating a zero position and a number of times that said first closure has been moved from said closed position to said open position after said seal is applied to said second closure; locking means cooperating with said indicating means for locking said first closure in said closed position when said first closure has been moved to said open position and returned to said closed position a predetermined number of times; and said housing also having means for shielding said indicating means and said locking means from tampering by a person inserting his hand through said first opening; said locking means including a lever which is moveable between locking and unlocking positions with regard to said first closure and which lever is accessible to be moved to said unlocking position only after said seal is broken and said second closure is moved to said open position.

The container or cassette made according to this invention provides a low-cost, simple, tampering-proof cassette which obviates the problems mentioned with some of the prior-art cassettes.

The cassette also includes a means for indicating the number of times the receiving door of the cassette has been opened and closed. This provides a check for unauthorized openings of the receiving door.

These advantages and others will be more readily appreciated after referring to the following description, claims, and drawing; accordingly, a list of additional advantages will be found at the conclusion of the detailed description of the invention.

DETAILED DESCRIPTION OF THE INVENTION

Figure 1:
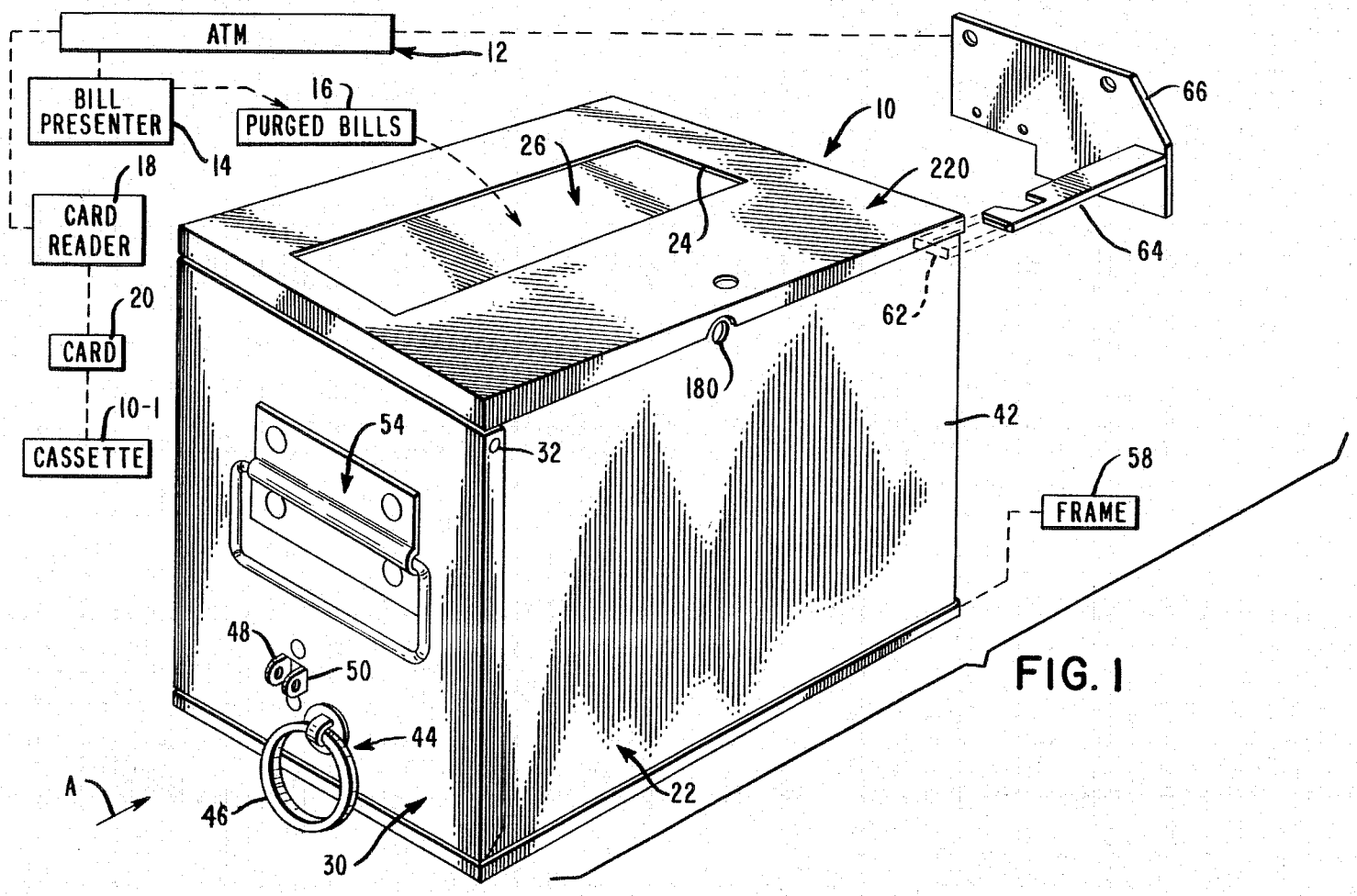
FIG. 1 is a general perspective view of a preferred embodiment of the cassette of a container or cassette which is made according to this invention, with its relationship to an automated teller machine (ATM) being shown diagrammatically.

FIG. 1 is a general perspective view of a preferred embodiment of a cassette 10 which incorporates the features of this invention. One use of the cassette 10 is to receive the "purged" bills in association with an automated teller machine (ATM) 12 as mentioned earlier herein. The ATM 12 is a conventional machine such as the NCR 5080, which is manufactured by the NCR Corporation of Dayton, Ohio.

The ATM 12 (shown diagrammatically in FIG. 1) includes a currency presenter 14 which receives and accumulates currency or bills as part of a routine cash dispensing transaction, as mentioned earlier herein. If a "double bill" is detected, for example, in the cash dispensing function, the "purged" bills 16 from the presenter 14 are deposited in the cassette 10 located inside the ATM 12 as mentioned earlier herein. The ATM 12 also includes a magnetic card reader 18 which receives and reads the identification card 20 used in the identification process mentioned earlier herein. Those cards like 20 which are captured by the ATM 12 for the reasons stated earlier herein may be routed to the cassette 10, or a separate cassette 10-1 may be provided where necessary or expedient for receiving the cards 20. Cassette 10-1 is identical to cassette 10; therefore, a description of only cassette 10 will be given.

The cassette 10 has a protective housing 22 which is made of durable metal to protect the contents thereof. The housing 22 has a first opening 24 therein and a first closure or door 26 which is moveable between the closed position shown in FIG. 1 and an open position in which purged bills 16, for example, may pass therethrough to the interior of the cassette 10. The housing 22 also has a second opening 28 (FIG. 2) therein and a second closure or door 30 which is moveable between the closed position shown in FIG. 1 and the open position shown in FIG. 2 with the door 30 being removed in FIG. 2. The door 30 has pins like 32, on opposing sides of the door 30, which coact with elongated slots 34 and 36 in the side panels 40 and 42, respectively, of the housing 22 to provide a conventional hinge for the door 30 and to permit the door 30 to be removed from the housing 22. The door 30 also has a seal 44 (FIG. 1) thereon which includes a ring 46 and a pair of spaced apertured uprights 48 and 50. The ring 46 is used to operate a locking, finger-type lever (not shown) which is rotated behind the flange 52 (FIG. 2) of the housing 22 to lock the door 30 on the housing 22. After locking, the ring 46 is pivoted from the position shown in FIG. 1 so that a portion of the ring 46 lies between the spaced uprights 48 and 50. Thereafter, a conventional seal (not shown) may be threaded through the apertures in the uprights 48 and 50 and sealed to give a visual indication of any tampering with the door 30. The door 30 also has a handle 54 secured thereto to facilitate carrying and handling of the cassette 10.

Before the cassette 10 is used in an ATM 12, it is prepared for such use by the host bank, for example. For the moment, it is sufficient to state that the preparation includes among other activities, setting an indicator means 56 (FIG. 3) which is used for indicating the number of cycles or times that the door 26 has been opened and closed. The indicator means 56 can also be set to have the door 26 locked after a predetermined number of such cycles have occurred. After the door 26 is so locked in use, it must be returned to the host bank, for example, where the breakable seal (not shown) passing through the uprights 48 and 50 is broken to permit the door 30 to be opened to gain access to the interior of the cassette 10 and its contents. The indicator means 56 can be set or changed only when the door 30 is removed.

Assume that the cassette 10 (FIG. 1) is empty, the indicator means 56 is set as described in the previous paragraph, the door 30 is sealed, and the cassette 10 is ready to be installed in an ATM 12. To install the cassette 10, it is pushed along an appropriate receiving frame 58 (FIG. 1) of the ATM 12, so that when the cassette 10 is finally seated in the frame 58, the opening 24 of the cassette will be aligned with the bill presenter 14 so as to receive the purged bills 16. Generally, these purged bills 16 fall into the cassette 10 by gravity although other techniques may be employed.

The back panel 60 (opposite to the door 30) has a slot 62 (FIG. 1) therein. The ATM 12 also has an actuating member 64 which is fixed to a portion 66 of the receiving frame 58, shown only diagrammatically in FIG. 1. As the cassette 10 is pushed along the receiving frame 58, the slot 62 is aligned with the actuating member 64, and as the actuating member 64 enters the slot 62, it opens the door 26 and initiates other activities to be described hereinafter as the cassette 10 is pushed into operative engagement with the member 64.

Figure 2:
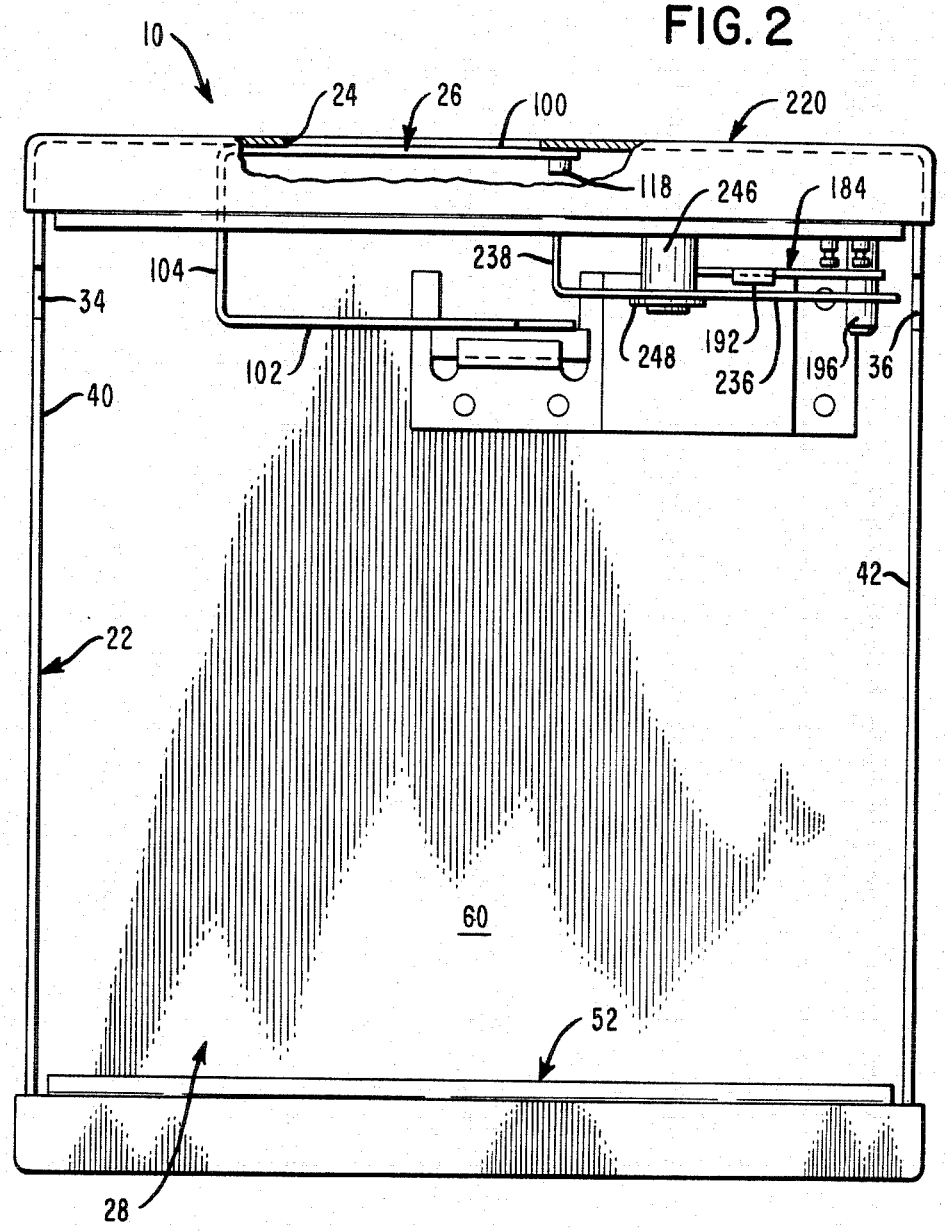
FIG. 2 is an elevational view of the cassette, looking from the direction of arrow A in FIG. 1, with the door removed to show the interior of the cassette.
Figure 3:
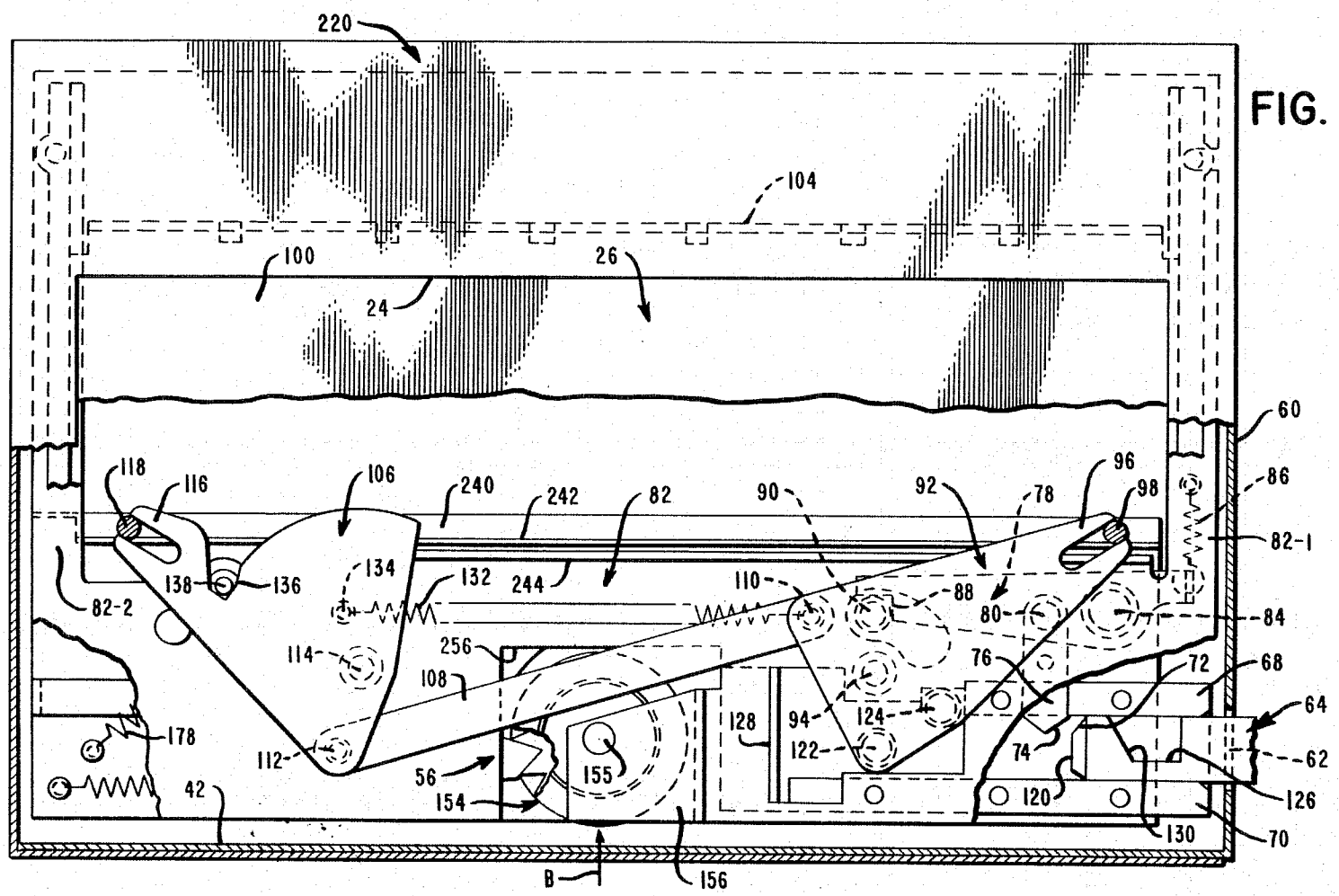
FIG. 3 is a plan view of the cassette shown in FIG. 1 with a portion of the top panel of the cassette being removed to show details of the means for opening the receiving door of the cassette and details of an indicator wheel which indicates the number of times the receiving door has been opened.

As the actuating member 64 enters the cassette 10 through the slot 62 (FIG. 3), it is guided between the stationary guide bars 68 and 70 (forming a channel) to enable a camming surface 72 on the actuator 64 to engage a camming surface 74 on a push rod 76 to push the rod 76 upwardly as viewed in FIG. 3. The push rod 76 has its other end pivotally joined to a blocking crank lever 78 (shown in dashed outline) by a pin 80. The crank lever 78 is pivotally mounted to the underside of the support plate 82 by a stud 84. One end of the crank lever 80 is connected to a tension spring 86 to resiliently bias the crank lever 78 to rotate in a counterclockwise direction as viewed in FIG. 3, and in doing so, a right angled abutment surface 88 on the lever 78 is brought into blocking relationship with a stud 90 which is secured to the underside of a door-opening arm 92 having the shape shown in solid outline in FIG. 3. The arm 92 is pivotally mounted on a stud 94 which is located on the underside of the arm 92 and is secured to support plate 82. The arm 92 is prevented from rotating in a clockwise direction, as viewed in FIG. 3, when the crank lever 78 is in the abutting position shown. The arm 92 has a bifurcated end 96 which engages a stud 98 depending from the underside of the top panel or surface 100 of the door 26, as seen best in FIG. 2, with a portion of the top surface 100 being removed in FIG. 3 to facilitate a showing of the arm 92. The door 26 has the top surface 100 mentioned, a bottom panel or surface 102, and a joining section 104 as seen best in FIG. 2.

The arm 92 is part of the opening and closing mechanism for door 26 which mechanism also includes the arm 106 and a link 108 joining the arms 92 and 106 via pins 110 and 112 as shown. The arm 106 is pivotally mounted on a stud 114 which is secured to an upstanding from the support plate 82. The arm 106 also has a bifurcated end 116 which receives a stud 118 which depends from the top surface 100 of door 26 as shown best in FIG. 2.

When the cassette 10 is pushed into the ATM 12, the actuating member 64 will engage the push rod 76 to move it upwardly (as viewed in FIG. 3) and the crank lever 78 will be rotated in a clockwise direction to move it out of blocking relationship with the stud 90 and the arm 92. As the actuating member 64 moves further into the cassette 10, its front edge 120 will engage a stud 122 which is secured to the underside of arm 92, causing the arm 92 to rotate in a clockwise direction as viewed in FIG. 3, which rotation begins to open door 26. In this regard, as arm 92 rotates in the clockwise direction, the arm 106 pivots in a counterclockwise direction about its pivot point or stud 114 to move to open the door 26 via the bifurcated end 116 and stud 118. The door 26 (FIG. 2) is opened by having it move to the right as viewed in FIG. 2 with the joining wall 104 clearing the opening 24 from the left side of the opening.

As this opening operation of door 26 progresses towards the fully-opened position, a second stud 124 secured to the underside of arm 92 is rotated into the recess 126 of the actuating member 64. As the arm 92 continues to rotate in response to the advancing actuating member 64, the stud 122 on the arm 92 abuts against an upturned wall 128 (bent up from support plate 82) to thereby limit the rotation of arm 92; the door 26 is now in the opened position with regard to opening 24.

The stud 124 (FIG. 3) coacts with a camming surface 130 in the recess 126 on actuating member 64 to prevent the cassette 10 from being withdrawn from the actuating member 64 (and the ATM 12) when the door 26 is in the opened position. As soon as the cassette 10 is pulled to withdraw it from the ATM 12, the camming surface 130 contacts stud 124 to rotate the arm 92 in a counterclockwise direction to initiate closing door 26. A long tension spring 132 having one end secured to the stud 110 on arm 92 and the remaining end thereof secured to a stud 134 upstanding from the support plate 82 is used to assist in returning the door 26 to the closed positions shown in FIGS. 2 and 3.

The mechanism for opening the door 26 just described is also used for actuating the indicator means 56 alluded to earlier herein. As the arm 106 (FIG. 3) rotates in a counterclockwise direction about the stud 114 (in association with the rotation of arm 92), a camming surface 136 on the arm 106 coacts with a stud 138 upstanding from a lever 140 (FIG. 5) which is pivotally mounted on a stud 142 which is secured to the underside of support plate 82 as seen best in FIG. 4. The free end of lever 140 has a stud 144 depending therefrom which coacts with a pawl member 146 which is pivotally mounted on a stud 148 which is secured to the underside of support plate 82. The pawl member 146 has a driving tooth 150 and a centering tooth 152 thereon which coact with an indicator wheel 154 which is part of the indicator means 56.

Figure 4:
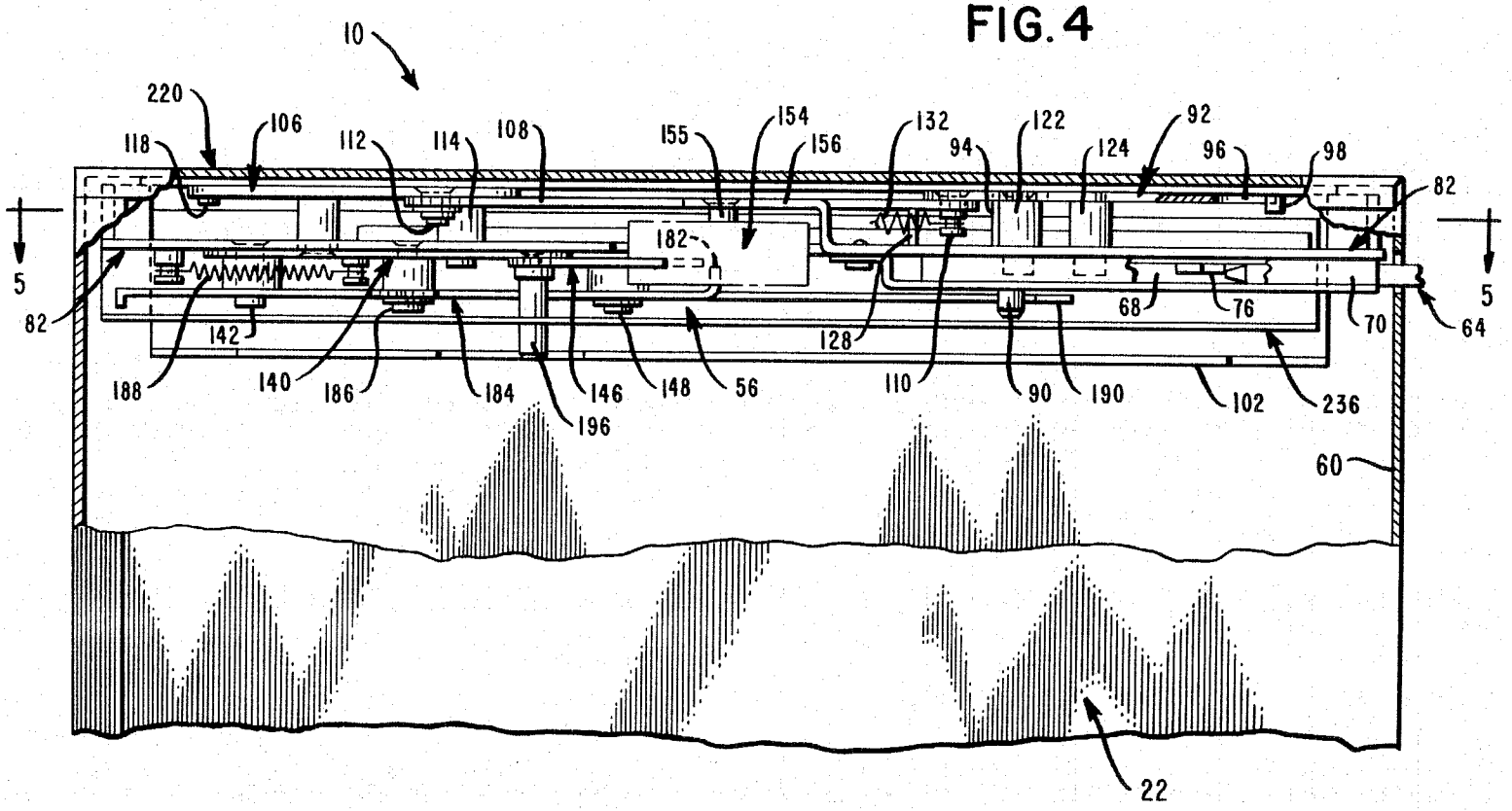
FIG. 4 is an elevational view taken from the direction B of FIG. 3, with the side panel of the cassette being removed to show additional details of the mechanism included therein.
Figure 5:
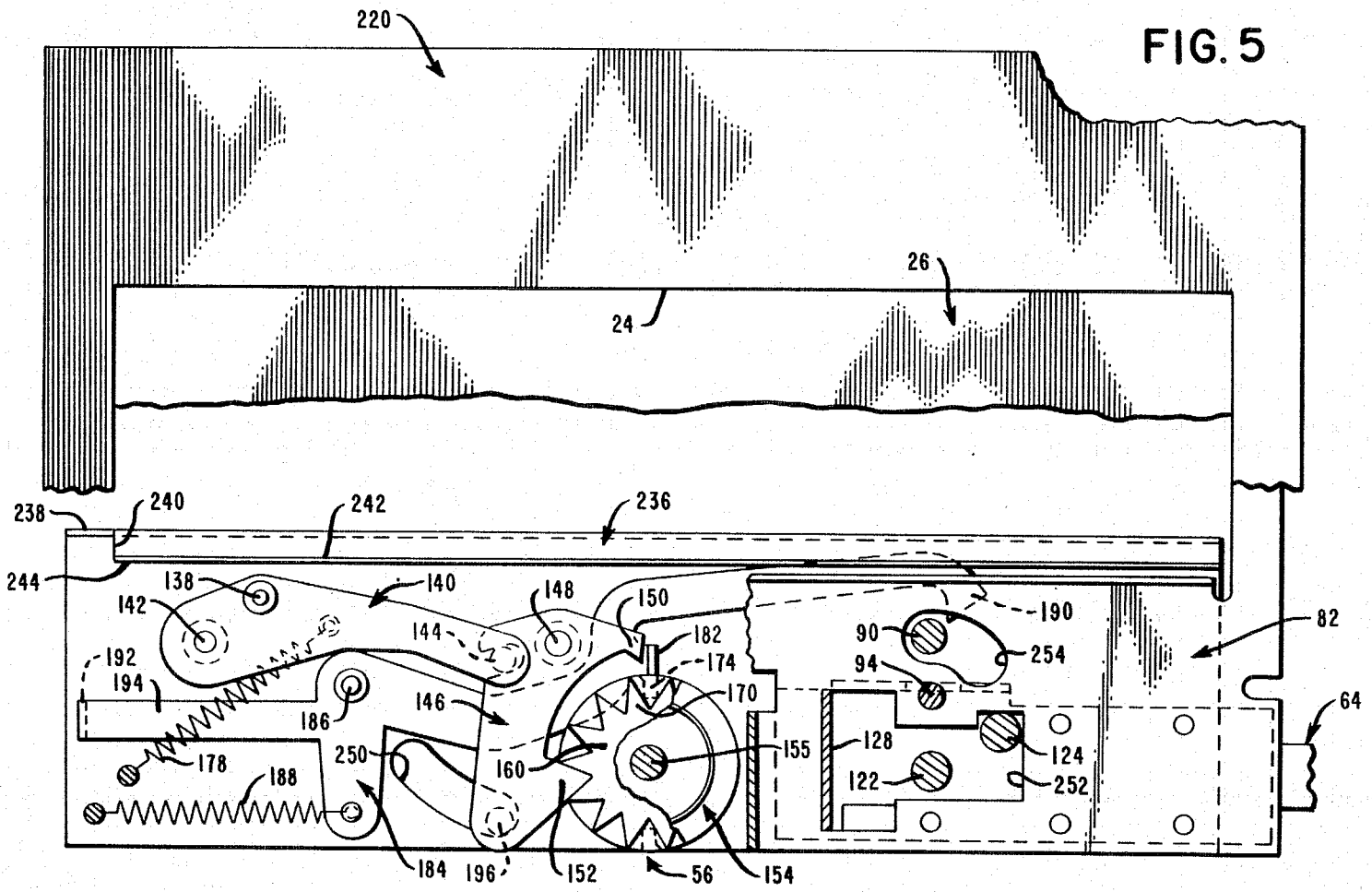
FIG. 5. is a cross sectional view, taken along the line 5—5 of FIG. 4, to show additional linkage associated with the means for indicating the number of times the first closure has been opened and closed.
Figure 6:
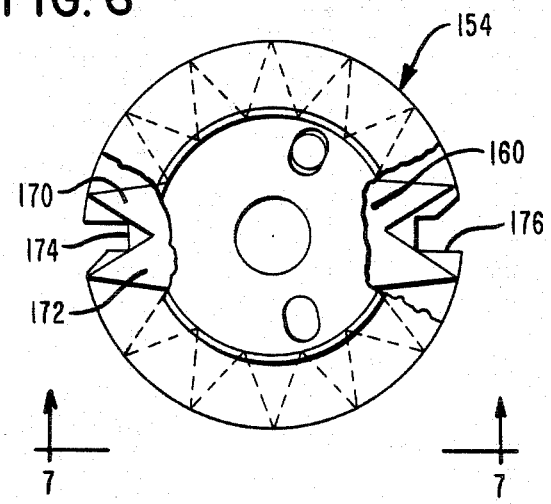
FIG. 6 is a top view of an indicator wheel shown in FIG. 5.
Figure 7:
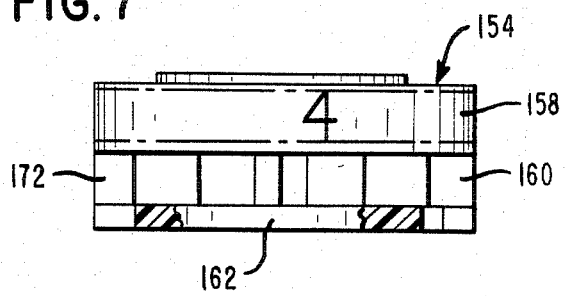
FIG. 7 is a side view of the indicator wheel shown in FIG. 6.
Figure 8:
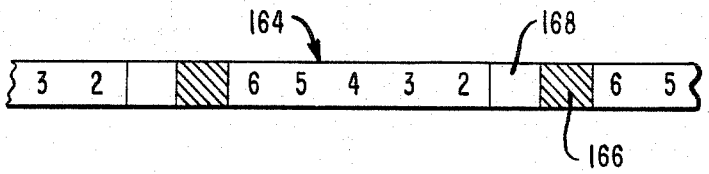
FIG. 8 is a diagrammatic view, showing the indicia appearing around the perimeter of the indicator wheel shown in FIG. 7.

The indicator wheel 154 shown in more detail in FIGS. 6, 7, and 8 is pivotally mounted on and retained on a stud 155 (FIG. 3) which is secured to the underside of a flange portion 156 of the support plate 82 as seen best in FIG. 4. The indicator wheel 154 has a top wheel 158 (FIG. 7), a ratchet wheel 160, and a lower wheel 162 which all rotate as a unit. The indicator wheel 154 has the indicia 164 thereon as shown in FIG. 8. The indicia includes a green area 166, a white area 168 and the numbers 2–6 as shown. The function of the indicia 164 will be described hereinafter.

The ratchet wheel 160 (FIGS. 6, 7) has teeth like 170 and 172 thereon, which are spaced around the periphery thereof to coact with the driving tooth 150 and the centering tooth 152 of the pawl member 146. The lower wheel 162 has two notches 174 and 176 therein which are spaced apart 180 degrees as shown in FIG. 6; the function of the notches 174 and 176 will be described hereinafter.

The opening of the door 26 affects the indicator wheel 154 in the following manner. As the door 26 begins to open as previously described, the arm 106 (FIG. 3) moves the stud 138 on the lever 140 (FIG. 5), causing the lever 140 to rotate in a counterclockwise direction (as viewed in FIG. 5) about stud 142 and against the bias of tension spring 178, causing the pawl member 146 to rotate in a clockwise direction about stud 148. When pawl member 146 rotates in a clockwise direction, its driving tooth 150 engages one of the teeth like 170 in FIG. 5, causing the indicator wheel 154 to rotate or index one position in a counterclockwise direction as viewed in FIG. 5 after its centering tooth 152 moves out of engagement with the ratchet wheel 160. The side panel 42 (FIG. 1) has a window 180 therein to permit the indicia 164 on the top wheel 158 to be visible from the outside of the cassette 10; however, in the embodiment described this window 180 is not visible when the cassette 10 is in operative engagement with the ATM 12. When the cassette 10 is removed from the ATM 12, the door 26 closes, and as a result of its closing, the rotation of the arm 106 and the lever 140 are reversed from that described on the opening of door 26 to rotate the pawl member 146 to drive its centering tooth 152 into engagement with the ratchet wheel 160. Each time the door 26 is opened and closed for a cycle, the indicator wheel 154 will indicate the increase in the number of cycles up to a predetermined amount.

The cassette 10 is designed to permit the number of cycles of opening and closing the door 26 to be set from one to six, for example, in the embodiment described. Assume that the indicator wheel 154 is set to permit six such cycles. As the pawl member 146 indexes the indicator wheel 154 for six such indexes, (with the number "6" appearing in window 180) a tang 182 on the lever 184 (FIG. 5) will drop into the notch 174 on the lower wheel 162. The lever 184 is pivotally mounted on a stud 186 secured to the underside of the support plate 82 as seen best in FIG. 4. The lever 184 is biased to rotate about stud 186 in a clockwise direction (as viewed in FIG. 5) by the tension spring 188 so as to enable the tang 182 thereon to ride on the periphery of the lower wheel 162 and to drop into one of the notches 174 or 176 when presented to the tang 182. When the tang 182 drops into a notch like 174 shown in FIG. 5, the lever 184 will rotate slightly in a clockwise direction, as viewed in FIG. 5, to move the end 190 of lever 184 into blocking engagement with the stud 90 secured to the underside of the door opening arm 92. When the end 190 falls to the right of stud 90 as viewed in FIG. 5, it prevents the arm 92 from rotating in a clockwise direction as viewed in FIG. 3 to prevent the door 26 from being opened. Thus, the cassette 10 must be returned to the host bank, in the example described, where the seal 44 (FIG. 1) must be broken to open the door 30. In a routine operation, when the door 30 is opened, the contents thereof whether identification cards 20 or purged bills 16 are processed routinely by the host bank, and thereafter, the indicator wheel 154 is reset as will be described hereinafter, and the door 30 is locked and sealed by the seal 44 as previously described. The cassette 10 is then ready for delivery to another ATM 12 to be inserted therein as previously described.

To reset the cassette 10 when the door 30 is opened, the following procedure is used. An operating handle 192 (FIG. 5) is provided on the arm 194 of the lever 184 to enable the lever 184 to be pivoted about stud 186 in a counterclockwise direction, as viewed in FIG. 5, to remove the tang 182 from the notch 174; this is analogous to moving the operating handle 192 to the right as viewed in FIG. 2. The pawl member 146 has an operating handle 196 which depends from the lower side thereof as is seen best in FIG. 4. To reset the indicator wheel 154, the operating handle 192 is moved to the right as viewed in FIG. 2 to remove the tang 182 from the notch 174 (FIG. 5), and thereafter, the pawl member 146 is moved in a clockwise direction (as viewed in FIG. 5) by moving the operating handle 196 to the left (as viewed in FIG. 2) to index the indicator wheel 154 one position, and then the handle 196 is released. At this time, the green area 166 (FIG. 8) of the indicator wheel 154 is positioned at the window 180 (FIG. 1). The door 30 is then locked and the seal 44 is applied. Prior to inserting the cassette 10 in an ATM 12, the operator checks the window 180 to make sure that the green area 166 is positioned thereat which means (in the embodiment described) that the door 26 has not been opened since the cassette was sealed.

When the cassette 10 is placed in an ATM 12, the opening of the door 26 will cause the indicator wheel 154 to index one position as previously described, causing the white area 168 (FIG. 8) to appear at the window 180. The white area 168 indicates one cycle of opening and closing which represents a routine operation, and therefore, the cassette 10, when removed from the ATM 12 may be routinely delivered to the host bank.

In the example being described, if the cassette 10 with a green area 166 in the window 180 is inserted in an ATM 12, the opening of the door 26 will cause the white area 168 to be displayed in the window 180. If, however, a jam or malfunction occurs in the presenter 14, for example, it may be necessary to remove the cassette 10 from the ATM 12 in order to fix the jam, for example. When the cassette 10 is placed into operative engagement with the ATM 12, the actuating member 64 will initiate the change in the number of cycles recorded on the indicator wheel 154, as previously described, causing the number "2" to be displayed at the window 180. If the cassette 10 and the ATM 12 perform thereafter without malfunction, the number "2" will still be displayed at the window 180. When the cassette 10 is returned to the host or central bank for further processing of the contents thereof, it must be accompanied by an explanation as to why an "extra" cycle (as evidenced by the number "2") of opening and closing the cassette 10 has occurred. In this situation, a note or explanation by the serviceman who repaired the malfunction might be adequate.

In the embodiment described, the cassette 10 may be set to record up to six cycles of opening and closing of the door 26 as described. When the cassette 10 is set with a green area 166 showing, it means that the image viewed through the window 180 will present a white area 168 for one such cycle, a "2" for two cycles, etc., up to a "6" for six such cycles. This series of colors and numbers is arranged and repeated between the notches 174 and 176 on the lower wheel 162 (FIG. 7). If the cassette 10 is to be set (prior to sealing) to permit only two cycles of operating before locking, for example, the pawl member 146 is indexed until the number "4" appears at the window 180. When the cassette 10 is installed on an ATM 12 and the door 26 opened in operative relationship with the ATM 12, the number "5" will appear at window 180. If the cassette 10 is removed from the ATM 12 to correct a fix or malfunction as previously described, and thereafter the cassette 10 is placed again in the ATM 12, the actuating member 64 will initiate the opening of door 26 to index the pawl member 146 causing the indicator wheel to show a "6" at window 180. The tang 182 on the lever 184 will drop into the next notch like 176 on the lower wheel 162 to thereby prevent the door 26 from being opened again until the seal 44 is broken and the door 30 is opened to permit access to the interior of the cassette 10 to reset the indicator wheel 154 as previously described.

Figure 9:
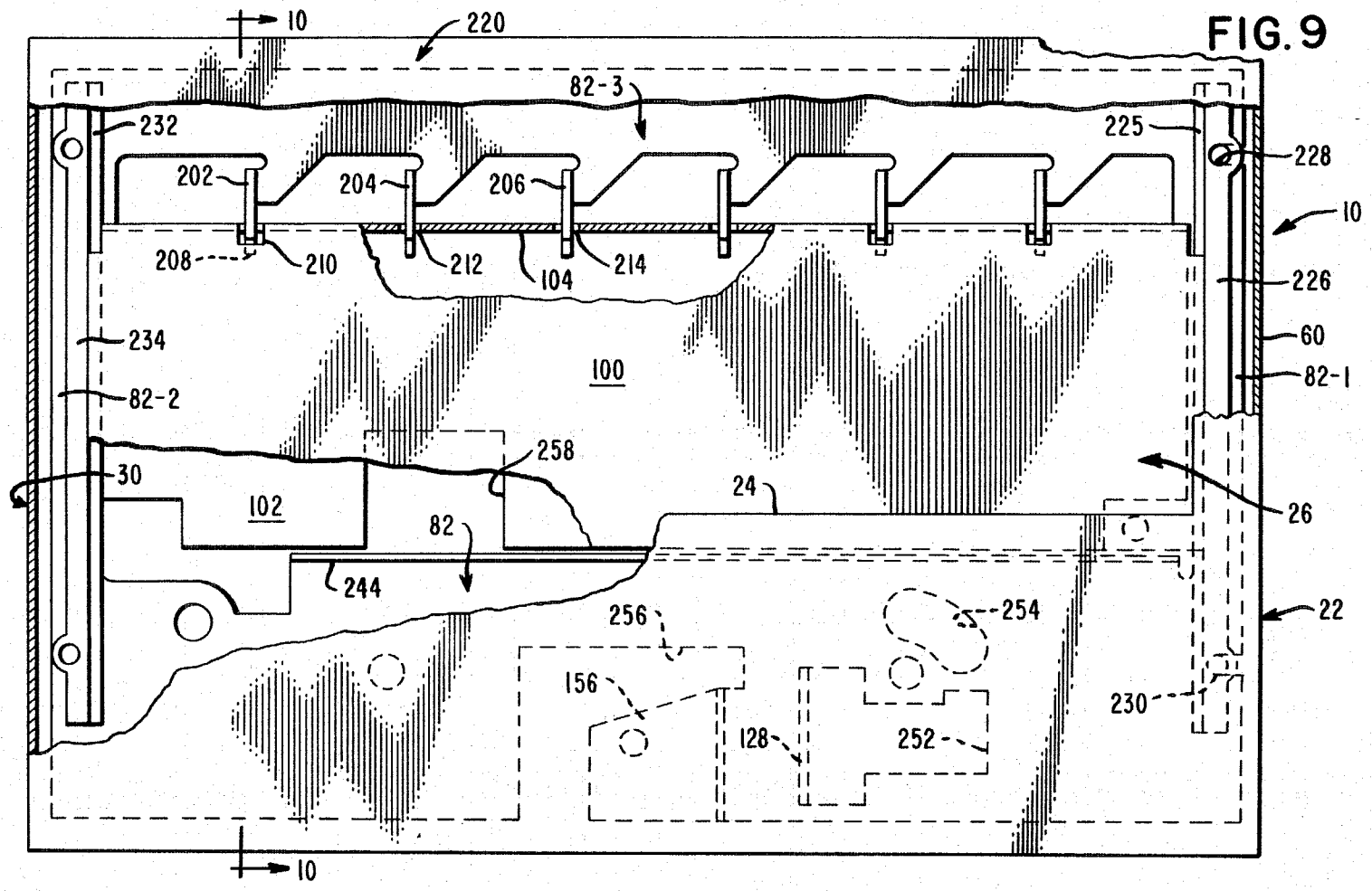
FIG. 9 is a plan view of the cassette, with certain portions of the top panel and the top door therein removed, to show additional details of the cassette.
Figure 10:
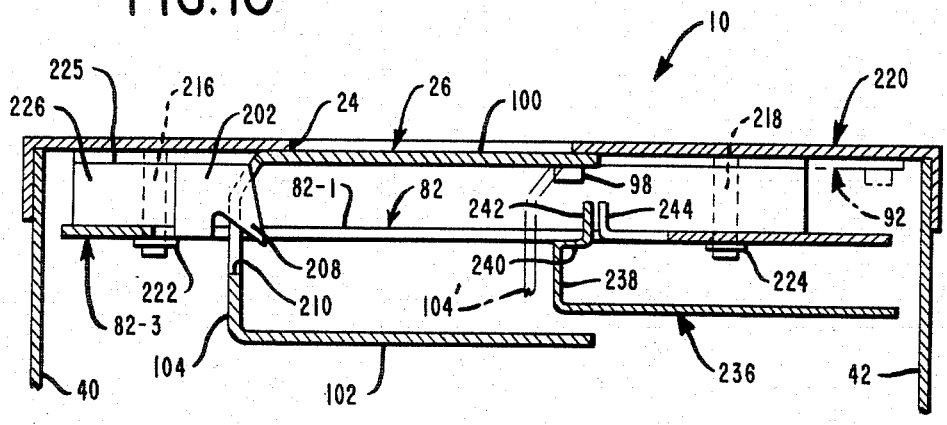
FIG. 10 is a cross-sectional view, taken along the line 10—10 of FIG. 9, to show additional details of the cassette.

FIGS. 9 and 10 show additional details of the construction of the cassette 10. The support plate 82 alluded to earlier herein with regard to FIG. 3, has the integrally-formed, spaced, side members 82-1 and 82-2, best seen in FIG. 3, and a plate 82-3, best seen in FIG. 9, joining the side members 82-1 and 82-2. The plate 82-3 has a plurality of spaced, upturned portions like 202, 204, and 206, for example, with each of these portions having a tooth thereon, like tooth 208 shown on portion 202 in FIG. 10. The door 26 has a plurality of spaced recesses like 210, 212, and 214 which are aligned to receive the teeth (like 208) on the associated upturned portions 202, 204, and 206, respectively, as seen best in FIG. 10. The support plate 82 is supported on four studs like studs 216 and 218 (FIG. 10) which depend from the cover 220 of the housing, and the plate 82 is retained on the studs 216, and 218, for example, by "C"-washers 222 and 224, respectively. The right side of the top surface 100 of the door 26 (as viewed in FIG. 9) rides in a groove 225 of a plastic glide bar 226 having holes 228 and 230 therein enabling it to be mounted on the studs 216 and 218, respectively. The left side of door 26 as viewed in FIG. 9 is similarly mounted in a groove 232 of a glide bar 234.

When the door 26 is opened by the actuating member 64 as previously described, the joining surface 104 thereof moves to the position shown in dashed outline 104' (FIG. 10) to permit the purged bills 16 to be deposited through the opening 24 as previously described. If the door 26 closes when a purged bill 16 is half in and half out of the opening 24, the bill 16 will be retained by the teeth 208 (FIG. 9). If a person tries to remove a purged bill 16 while retained by the teeth 208, it will be ripped in half, generally, and the fact that half of a purged bill is within the cassette 10 (when later officially opened) will also give an indication of tampering.

The cassette 10 also has a security plate 236 having the cross sectional shape shown in FIG. 10. The function of the plate 236 is to shield the indicator means 56 from tampering. The security plate 236 has the vertical section 238 (FIG. 10), the short horizontal section 240 and a joining, short, vertical section 242 which extends along the length of opening 24 as seen better in FIG. 5. A portion of the support plate 82 is removed in FIG. 5 to facilitate a showing of the security plate 236. The section 242 is essentially a lip which extends in a direction which is parallel to a flange or lip 244 (FIG. 5) on the support plate 82. The security plate is secured to the underside of the support plate 82 by shouldered studs and "C"-washers 246 and 248, respectively, as shown in FIG. 2. The security plate 236 has an arcuately-shaped slot 250 therein (FIG. 5) to provide clearance for the operating handle 196 of the pawl member 146 to be manipulated as previously explained.

The support plate 82 has an area 252 (FIG. 5) removed therefrom to accommodate the movement of the studs 122 and 124, and also has an arcuately-shaped area 254 to accommodate the movement of stud 90 associated with the door opening arm 92. A notched-out area 256 (FIG. 3) provides clearance for mounting the indicator wheel 154 as previously described. The bottom panel or surface 102 of the door 26 has a notch 258 (FIG. 9) therein to provide clearance for the operating handle 196 of the pawl member 146 when the door 26 is moved to the open position.

Some of the advantages of the cassette 10 are as follows:

1. The door 26 (FIG. 1) is opened and closed, positively, via the actuating member 64.

2. The cassette 10 (FIG. 1) cannot be removed from the ATM 12 when the door 26 is in the open position.

3. The indicator wheel 154 (FIG. 3) can be programmed to lock the door 26 after a predetermined number of cycles of opening and closing of door 26. Such locking requires that the seal 44 be broken and the door 30 removed or opened in order to reset the indicator wheel 154.

4. When the door 26 is opened, the security plate 236 and the lower panel or surface 102 of the door 26 prevent the indicator wheel from being changed by reaching in through the opening 24 in the housing 22.

What is claimed is:

1. A tampering-proof container for receiving and storing items, comprising:

a housing having first and second openings therein;

a first closure moveable between closed and open positions with regard to said first opening;

a second closure moveable between closed and open positions with regard to said second opening;

a seal to secure said second closure in said closed position and to permit said second closure to be moved to said open position only upon breaking said seal to thereby give an indication that said second closure has been opened;

means for moving said first closure from said closed position to said open position to enable said items to be received through said first opening and also for moving said first closure from said open position to said closed position;

means for indicating a zero position and a number of times that said first closure has been moved from said closed position to said open position after said seal is applied to said second closure;

locking means cooperating with said indicating means for locking said first closure in said closed position when said first closure has been moved to said open position and returned to said closed position a predetermined number of times; and said housing also having means for shielding said indicating means and said locking means from tampering by a person inserting a hand through said first opening;

said locking means including a lever which is moveable between locking and unlocking positions with regard to said first closure and which lever is accessible to be moved to said unlocking position only after said seal is broken and said second closure is moved to said open position;

said moving means comprising:

an actuating member which is separate from said container;

a first lever pivotally mounted in said housing and operatively coupled to said first closure to move said first closure between said open and closed positions; and a second lever pivotally mounted in said housing for movement between blocking and unblocking positions with regard to said first lever;

said housing having a channel in which said actuating member may be inserted;

said second lever being moveable to said unblocking position only when said actuating member is moved into said housing in said channel to engage said second lever; and thereafter, continued movement of said actuating member into said channel will engage said first lever to pivot said first lever to thereby move said first closure to said open position.

2. The container as claimed in claim 1 in which said first lever has a stud thereon and in which said actuating member has a recess therein to receive said stud as said actuating member is moved into said channel in said housing; said stud and said actuating member being effective to pivot said first lever to move said first closure to said closed position.

3. The container as claimed in claim 2 in which said indicating means includes an indicator wheel, a ratchet wheel and a notched wheel having a periphery with at least one notch therein;

said indicator wheel, ratchet wheel, and notched wheel being rotatably mounted in said housing to be rotated as a unit;

a pawl member operatively connected to said ratchet wheel; and linkage connecting said first lever with said pawl member to index said ratchet wheel one position each time said first closure is moved to said open position, said locking means including a locking lever which rides on the periphery of said notched wheel and coacts with said notch to lock said notched wheel against rotation and thereby lock said first closure in said closed position.

4. The container as claimed in claim 3 in which said housing has spaced teeth therein and said first closure has spaced slots therein to receive said spaced teeth therein when said first closure is in said closed position.

5. A tampering-proof container for receiving and storing items, comprising:

a housing having first and second openings therein;

a first closure moveable between closed and open positions with regard to said first opening;

a second closure moveable between closed and open positions with regard to said second opening;

a seal to secure said second closure in said closed position and to permit said second closure to be moved to said open position only upon breaking said seal to thereby give an indication that said second closure has been opened;

means for moving said first closure from said closed position to said open position to enable said items to be received through said first opening and also for moving said first closure from said open position to said closed position;

means for indicating a zero position and a number of times that said first closure has been moved from said closed position to said open position after said seal is applied to said second closure;

locking means cooperating with said indicating means for locking said first closure in said closed position when said first closure has been moved to said open position and returned to said closed position a predetermined number of times; and said housing also having means for shielding said indicating means and said locking means for tampering by a person inserting a hand through said first opening;

said locking means including a lever which is moveable between locking and unlocking positions with regard to said first closure and which lever is accessible to be moved to said unlocking position only after said seal is broken and said second closure is moved to said open position;

said housing having spaced teeth therein and said first closure having spaced slots therein to receive said spaced teeth therein when said first closure is in said closed position.

6. The container as claimed in claim 5 in which said first closure has a top panel, bottom panel, and a joining panel, with said spaced slots being located in said joining panel; said bottom panel being moved towards said indicating means and said locking means when said first closure is moved to said open position to assist said shielding means in shielding said indicating means and said locking means from said tampering.

* * * * *